US008317064B2

(12) United States Patent
Pang

(10) Patent No.: US 8,317,064 B2
(45) Date of Patent: Nov. 27, 2012

(54) SMALL STORAGE RECEPTACLE FOR FOOD WITH AIR INFLUX HOLE

(76) Inventor: Won-Seo Pang, Deajeon (KR)

( * ) Notice: Subject to any disclaimer, the term of this patent is extended or adjusted under 35 U.S.C. 154(b) by 600 days.

(21) Appl. No.: 12/522,990

(22) PCT Filed: Feb. 15, 2008

(86) PCT No.: PCT/KR2008/000904

§ 371 (c)(1),
(2), (4) Date: Jul. 13, 2009

(87) PCT Pub. No.: WO2008/102964

PCT Pub. Date: Aug. 28, 2008

(65) Prior Publication Data

US 2010/0044397 A1 Feb. 25, 2010

(30) Foreign Application Priority Data

Feb. 21, 2007 (KR) ..... 20-2007-0003004 U

(51) Int. Cl.
*B65D 37/00* (2006.01)
*B65D 5/72* (2006.01)
*B67D 3/00* (2006.01)

(52) U.S. Cl. ..... 222/212; 222/481; 222/482; 222/494

(58) Field of Classification Search ..... 222/158, 222/205, 207, 212, 213, 476, 481, 482, 494, 222/575; 137/843, 852, 854, 859
See application file for complete search history.

(56) References Cited

U.S. PATENT DOCUMENTS

| | | | | | |
|---|---|---|---|---|---|
| 2,295,062 | A * | 9/1942 | Townsend | 128/841 |
| 2,913,000 | A * | 11/1959 | Roberts | 137/854 |
| 3,241,726 | A * | 3/1966 | Chester | 222/211 |
| 3,669,323 | A * | 6/1972 | Harker et al. | 222/490 |
| 4,105,142 | A * | 8/1978 | Morris, Jr. | 222/158 |
| 4,401,224 | A * | 8/1983 | Alonso | 215/11.5 |
| 4,658,979 | A * | 4/1987 | Mietz et al. | 220/203.13 |
| 4,842,165 | A * | 6/1989 | Van Coney | 222/95 |
| 5,277,171 | A * | 1/1994 | Lannes | 122/14.31 |
| 5,433,353 | A * | 7/1995 | Flinn | 222/481 |
| 5,857,595 | A * | 1/1999 | Nilson | 222/212 |
| 2004/0232169 | A1 * | 11/2004 | Glover et al. | 222/212 |

FOREIGN PATENT DOCUMENTS

| | | |
|---|---|---|
| JP | 08119298 | 5/1996 |
| JP | 09202344 | 8/1997 |
| JP | 2001002108 | 1/2001 |
| KR | 9527397 | 10/1995 |
| KR | 200305762 | 3/2003 |

* cited by examiner

*Primary Examiner* — Kevin P Shaver
*Assistant Examiner* — Nicholas Weiss
(74) *Attorney, Agent, or Firm* — Cantor Colburn LLP

(57) ABSTRACT

The present invention relates to a small-sized food storage receptacle with an air inlet that includes a receptacle body having a food storage space adapted to be squeezed out of shape by the application of an external pressure thereto and be returned to its original shape if the external pressure is removed, a food outlet adapted to discharge the food to the outside when the food storage space is squeezed out of shape, and the air inlet formed along the top portion of the food storage space so as to supply external air to the food storage space, while having a size enough to allow the food to be smoothly fed therein by means of an automatic feeding device in a food manufacturing company.

22 Claims, 10 Drawing Sheets

(A)

(B)

(A)

(B)

SMALL STORAGE RECEPTACLE FOR FOOD WITH AIR INFLUX HOLE

TECHNICAL FIELD

The present invention relates to a small-sized food storage receptacle with an air inlet, and more particularly, to a small-sized food storage receptacle with an air inlet that is adapted to store various kinds of foods like ketchup, red pepper paste, mayonnaise and so on therein, such that whenever needed, the foods are squeezed and discharged smoothly to the outside.

BACKGROUND ART

Generally, after the foods like ketchup, red pepper paste, mayonnaise and so on are made by food manufacturing companies and then are stored in small-sized storage receptacles, they are put on the market.

Peoples buy the food as needed, and they squeeze the food contained in the storage receptacles in order to eat it.

When an external pressure is applied to the receptacle body so as to squeeze the food from the food storage space of the storage receptacle, by the way, conventional food storage receptacles have a problem in that since external air is not smoothly supplied to the food storage space, the food is not smoothly discharged from the food storage space.

Additionally, the receptacle body is returned to its original shape only when the external air is supplied to the food storage space by the amount of food discharged from the food storage space, but actually, the external air is not smoothly supplied to the food storage space such that the receptacle body is crumpled or deformed.

Later, when the external pressure is applied to the crumpled receptacle body so as to squeeze the food again, it is more difficult to discharge the food from the food storage space of the storage receptacle.

The above-mentioned problems are caused by a structure wherein the external air is inevitably introduced into the receptacle through only a food outlet for discharging the food.

In the meantime, there is disclosed Korean Utility Model Registration No. 0305762 (Application No. 20-2002-0031233) as filed by the same inventor as the present invention, wherein external air is smoothly supplied to the interior of a receptacle body.

However, the prior art has some problems in that the storage receptacle is difficult to be really applicable to a production line in a food manufacturing company.

Unfortunately, that is, the food may be leaked through an air introduction passageway while the food is fed into the storage receptacle and in a state where the entrance of the storage receptacle is sealed after feeding.

DISCLOSURE OF INVENTION

Technical Problem

Accordingly, the present invention has been made to solve the above problems occurring in the prior art, and it is an object of the present invention to provide a small-sized food storage receptacle with an air inlet that permits external air by the amount of food discharged to be smoothly supplied to the interior of a receptacle body when an external pressure is applied to the receptacle body so as to discharge the food, and that prevents the receptacle body from being deformed.

It is another object of the present invention to provide a small-sized food storage receptacle with an air inlet that can be applied to a production line in a food manufacturing company, thereby preventing the food from being leaked through an air supply passageway during the feeding of the food into the storage receptacle and during the process of the distribution of the food after feeding, such that the storage receptacle can be useful for both general consumers and food manufacturing companies.

Technical Solution

To achieve the above objects, there is provided a small-sized food storage receptacle with an air inlet, in which the air inlet is formed on a receptacle body so that when an external pressure is applied to the receptacle body so as to discharge the food, external air is smoothly supplied to the interior of a receptacle body by the amount of food discharged, thereby enabling the food stored therein to be smoothly discharged to the outside.

Further, the storage receptacle according to the present invention can have a food outlet cap adapted to be mounted on a food outlet so as to control the discharging of the food, can permit the food to be fed into a food storage space through the air inlet formed along the top portion of the receptacle body, and can allow the air inlet to be easily sealed after the feeding of the food and easily released from the sealing state thereof, such that the storage receptacle can be applied to a production line.

The storage receptacle according to the present invention includes a receptacle body having a food storage space adapted to be squeezed out of shape by the application of an external pressure thereto and be returned to its original shape if the external pressure is removed so as to store a food of a relatively thick liquid state therein, a food outlet adapted to discharge the food to the outside when the food storage space is squeezed out of shape, and the air inlet formed along the top portion of the food storage space so as to introduce external air to the food storage space, the air inlet having a size enough to allow the food to be smoothly fed into the food storage space by means of an automatic feeding device in a food manufacturing company.

Furthermore, the storage receptacle according to the present invention includes an air inlet cap made of a synthetic resin material and adapted to be separably coupled to the air inlet in such a manner as to be covered on the air inlet to protect the air inlet, the air inlet cap having a plurality of air holes punched to supply external air to the air inlet of the receptacle body from the inside of the air inlet cap and air hole opening/closing parts adapted to come into close contact with the air holes by means of a discharge pressure generated in the food storage space when the food storage space is squeezed so as to close the air holes and adapted to be separated from the air holes by means of an absorbing pressure generated in the food storage space when the food storage space is returned to its original shape after squeezing so as to allow the external air to be supplied to the food storage space.

Moreover, the storage receptacle according to the present invention has a food outlet cap adapted to cover the food outlet of the receptacle body so as to prevent the food outlet from being stained and at the same time to control the discharging of the food.

Advantageous Effects

According to the present invention, there is provided a small-sized food storage receptacle with an air inlet, in which the air inlet is formed on the receptacle body and the air hole opening/closing parts is formed to stop or permit the air supply by means of the discharging pressure and absorbing pressure generated in the food storage space, such that when the external pressure is applied to the receptacle body so as to discharge the food, external air by the amount of food discharged is smoothly supplied to the interior of the receptacle body, thereby enabling the food stored therein to be smoothly discharged to the outside.

Further, the storage receptacle according to the present invention can have the food outlet cap adapted to be mounted on the food outlet so as to control the discharge of the food, can permit the food to be fed into the food storage space through the air inlet formed along the top portion of the receptacle body, and can have the air inlet cap adapted to be separably coupled to the air inlet so as to easily seal the air inlet after the feeding of the food and to be easily released from the sealing state thereof, such that the storage receptacle can be useful for both general consumers and food manufacturing companies if they want to store and market the food.

BRIEF DESCRIPTION OF THE DRAWINGS

FIGS. 2A and 2B are cross-sectional views showing a food outlet cap and air hole opening/closing parts in the storage receptacle according to the present invention, wherein FIG. 2A shows a state where the air holes are closed such that external air is not supplied, and FIG. 2B shows a state where the air holes are opened such that the external air is supplied.

FIGS. 3A to 3C are cross-sectional views showing a structure where the air hole opening/closing part having an interrupter, a fixing protrusion and curved grooves is mounted on the air inlet cap in the storage receptacle according to the present invention, wherein FIG. 3A shows a state where absorbing pressure and discharging pressure are not applied, FIG. 3B shows a state where the discharging pressure is applied, and FIG. 3C shows a state where the absorbing pressure is applied.

FIGS. 4A and 4B are cross-sectional views showing the air hole opening/closing part having the interrupter, the fixing protrusion and the curved grooves in the storage receptacle according to the present invention, wherein FIG. 4A shows a structure where the surfaces forming the curved groove are linearly formed and FIG. 4B shows a structure where the surfaces forming the curved groove are concaved.

FIGS. 5A to 5C are cross-sectional views showing the food outlet cap in the storage receptacle according to the present invention, wherein FIG. 5A shows a state where the stored food is not discharged, FIG. 5B shows a state where the food is discharged by means of the application of the discharging pressure, and FIG. 5C shows a state where the absorbing pressure is applied.

BEST MODE OF CARRYING OUT THE INVENTION

Figure 1:
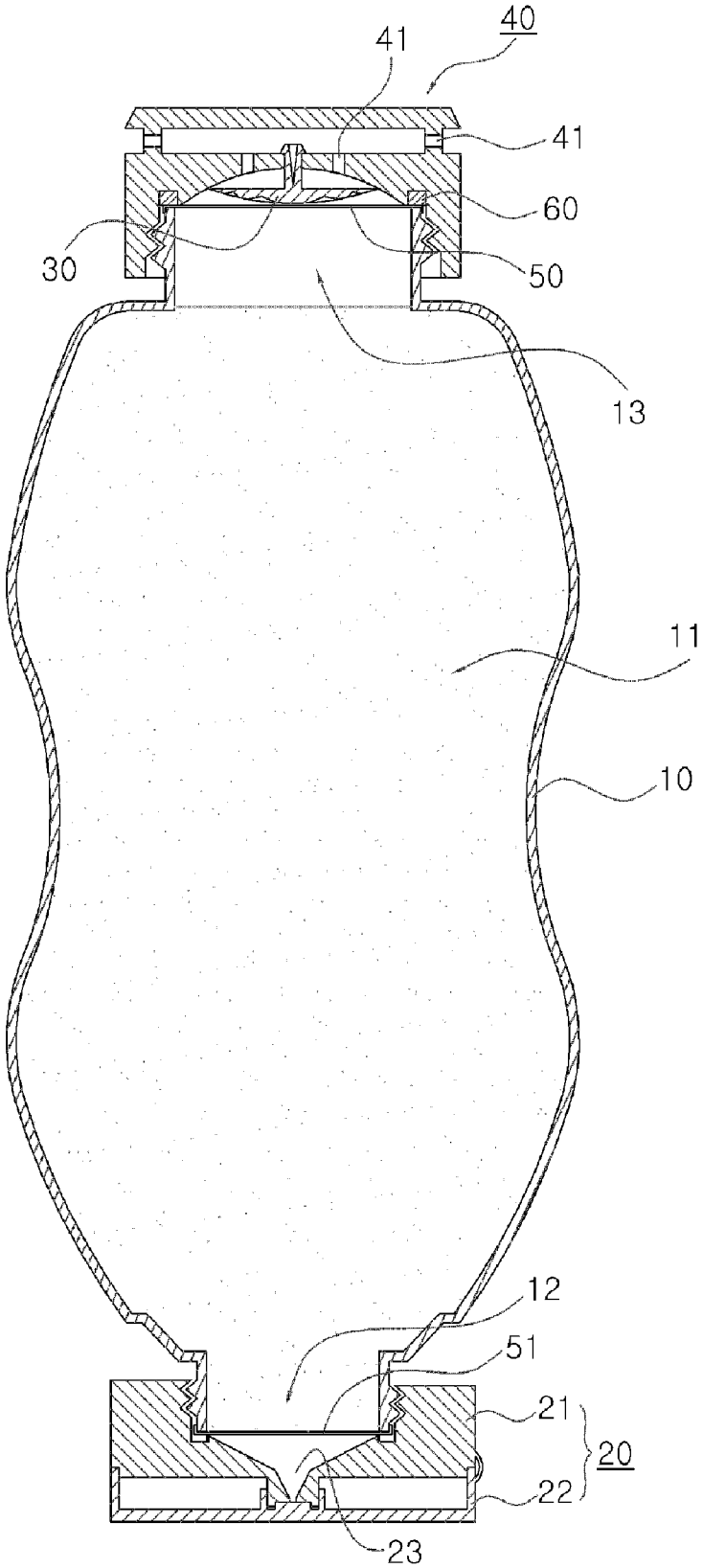
FIG. 1 is a cross-sectional view showing the use state of a small-sized food storage receptacle with an air inlet according to the present invention.

Now, reference will be made in detail to preferred embodiments of the present invention with reference to the attached drawings.

The present invention relates to a small-sized food storage receptacle with an air inlet, and particularly, to a small-sized storage receptacle that discharges the food stored therein when squeezed.

Therefore, the storage receptacle of this invention includes a receptacle body 10 and a food outlet cap 20.

The receptacle body 10 has a food storage space 11 adapted to store a generally thick liquid type of food therein, and the food storage space 11 is squeezed out of shape if an external pressure is applied thereto and is returned to its original shape if the external pressure is removed.

Further, the receptacle body has a food outlet 12 adapted to discharge the food to the outside when the food storage space 11 is squeezed.

The food outlet cap 20 is covered on the food outlet 12 of the receptacle body 10 so as to prevent the food outlet 12 from being stained.

According to the present invention, by the way, the storage receptacle is aimed to allow external air by the amount of food discharged to be supplied to the food storage space 11, thereby enabling the food stored therein to be smoothly discharged to the outside.

Therefore, the receptacle body 10 of the storage receptacle according to the present invention has an air inlet 13 adapted to permit the external air to be supplied to the food storage space 11.

Even though the air inlet 13 is formed on the receptacle body 10, the food should be discharged through only the food outlet 12.

Thus, there are provided a plurality of air hole opening/closing parts 30 that are adapted to come into close contact with air flow passageways by means of a discharge pressure generated in the food storage space 11 when the food storage space 11 is squeezed so as to close the air flow and that are adapted to be separated from the air flow passageways by means of an absorbing pressure generated in the food storage space 11 when the food storage space 11 is returned to its original shape after the squeezing so as to supply the external air to the food storage space 11.

The air hole opening/closing parts 30 may be composed of a check valve as well known.

Figure 2:
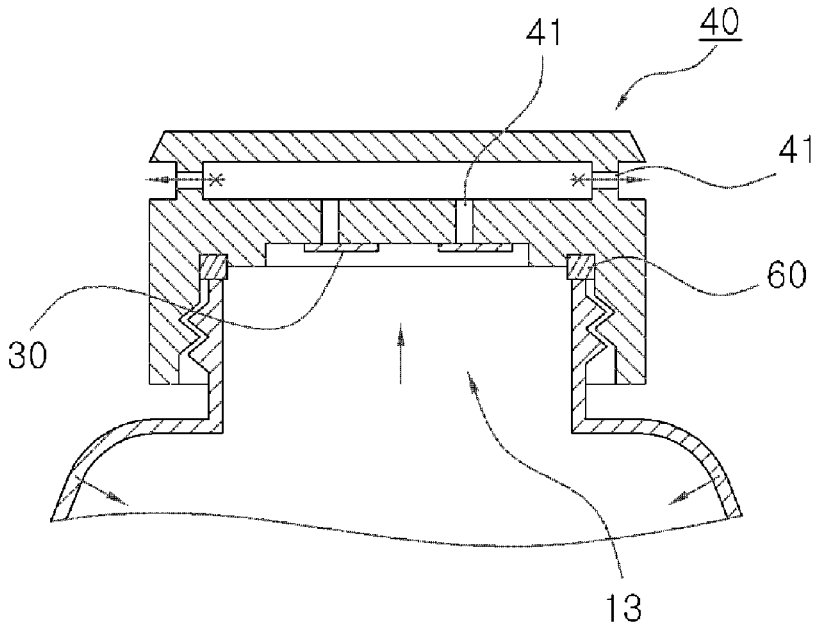
Figure 2:
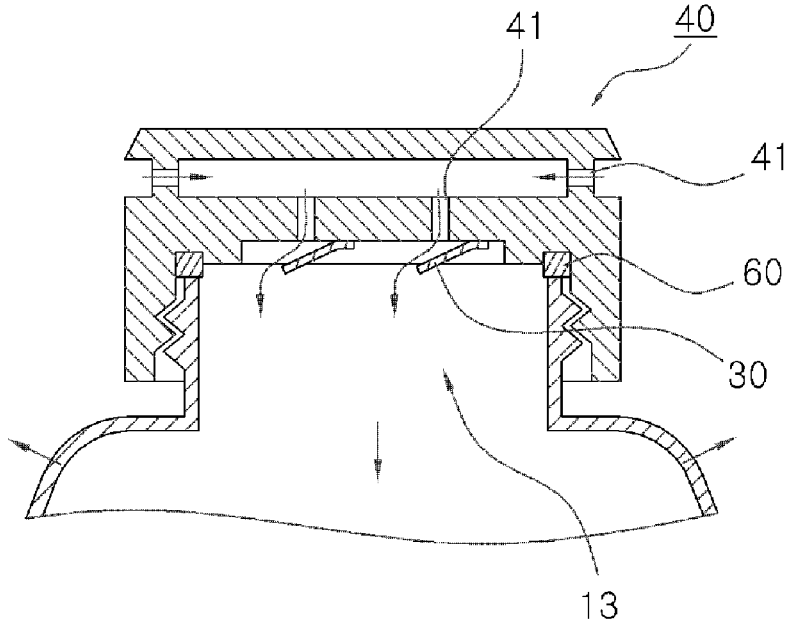

When the production costs are considered, however, relatively thin films as shown in FIG. 2 are moved by the discharging and absorbing pressures of the food storage space 11, thereby opening and closing the air flow passageways, which is a well known and really applicable structure.

By the way, the storage receptacle that has only the air inlet 13 and the air hole opening/closing parts 30 formed on the receptacle body 10 can not be really applied to the production line of the food manufacturing company.

In other words, the conventional small-sized food storage receptacles are configured to feed the food to the food storage space 11 via the food outlet 12.

In the conventional storage receptacles, therefore, as the food outlet 12 is formed on the uppermost end of the receptacle body 10, the air inlet 13 is formed on the lowermost end or in the middle portion thereof, which is located to a substantially lower position than the food outlet 12.

As a result, the air hole opening/closing parts 30 fail to perform their function when the food is filled to the food storage space 11 from the automatic feeding device on the production line, with a result that the food leaks to the outside through the air inlet 13.

Further, the air hole opening/closing parts 30 fail to perform their function when external impacts are applied to the storage receptacle during the distribution in the market, with a result that the food leaks to the outside through the air inlet 13.

So as to solve these problems, thus, the food outlet cap 20 of the storage receptacle according to the present invention is adapted to control the discharging of the food through the food outlet 12.

Furthermore, the air inlet 13 having a relatively large size (desirably in a range between 25 mm and 100 mm in case of a generally small-sized storage receptacle) is formed on the top portion of the food storage space 11, such that the food pouring from the automatic feeding device in the food manufacturing company can be smoothly fed in the food storage space 11 through the air inlet 13.

That is, the food outlet 12, which is closed by means of the food outlet cap 20 so as to prevent the food from being discharged to the outside, is formed on the bottom portion of the receptacle body 10, and the air inlet 13 is formed on the top portion thereof.

Under the above configuration, the food is fed to the food storage space 11 through the air inlet 13.

According to the above-described configuration, therefore, the food can not be leaked to the outside of the receptacle body 10 while the food pouring from the automatic feeding device on the production line is being filled in the food storage space 11.

By the way, if the air hole opening/closing parts 30 are mounted directly on the air inlet 13, the food cannot be rapidly and smoothly filled in the food storage space 11.

Also, if the air hole opening/closing parts 30 are mounted directly on the air inlet 13 after the food is filled in the food storage space 11, the food may leak to the outside of the storage receptacle when external impacts are applied to the storage receptacle during the distribution in the market.

Especially, fine dusts or bacteria enter the air flow passageways such that the food may be spoiled or rotten.

So as to overcome the above-mentioned problems, therefore, the storage receptacle according to the present invention has an air inlet cap 40 made of a synthetic resin material and adapted to be separably coupled to the air inlet 13 in such a manner as to cover and protect the air inlet 13, the air inlet cap 40 having a plurality of air holes 41 punched to supply external air to the air inlet 13 of the receptacle body 10 from the inside of the air inlet cap 40.

Further, the air inlet cap 40 has the air hole opening/closing parts 30 adapted to come into close contact with the air holes 41 by means of a discharge pressure generated in the food storage space 11 so as to close the air holes 41 and adapted to be separated from the air holes 41 by means of an absorbing pressure generated in the food storage space 11 so as to supply the external air to the food storage space 11.

The reason why the air inlet cap 40 is separably coupled to the air inlet 13 is that the air inlet 13 is completely blocked by means of coated paper 50 or vinyl after the food is filled in the food storage space 11 so as to prevent dusts or bacteria from entering the food storage space 11 and then, the air inlet cap 40 is coupled to the air inlet 13.

That is, the air inlet 13 is completely blocked by means of the coated paper 50 or vinyl, thereby preventing the food from being leaked to the outside even when external impacts are applied during the distribution to the storage receptacle and also preventing external dusts or bacteria from entering the food storage space 11.

When the storage receptacle is really used, however, the coated paper 50 or vinyl should be removed out of the air inlet 13 so as to allow the air inlet 13 to perform its function.

So as to remove the coated paper 50 or vinyl out of the air inlet 13 by a user, the air inlet cap 40 is configured to be separably coupled to the air inlet 13.

The method for attaching the coated paper 50 or vinyl on a receptacle entrance is a well-known technique, which will not be explained for the brevity of the description.

In blocking the air inlet of the storage receptacle by using the coated paper 50 or vinyl, however, the coated paper or vinyl is just covered on the air inlet 13 and the air inlet cap 40 is then coupled to the air inlet 13, thereby completely blocking the air inlet 13, which is unlike the conventional methods.

At this time, the coated paper or vinyl desirably has sterilizing processing.

On the other hand, a separate tool like a cork cap may be adopted to block the air inlet 13, and then, it is coupled to the air inlet cap 40.

Of course, when the food is just used after the feeding in the food storage space 11 in a house, the structure for blocking the air inlet 13 is not needed (when only the storage receptacle is purchased and used, and otherwise, when the storage receptacle made by the food manufacturing company is reused in a house after the food stored therein is all consumed).

The food outlet cap 20 for controlling the discharging of the food may have a variety of known structures adopted in all kinds of food storage receptacles.

In more detail, in a structure having a food outlet having a relatively small sectional area wherein the food is discharged to a small quantity, a typical food outlet cap structure is provided such that if the food outlet cap is removed, the food is just discharged to the outside (which is not shown in the drawings).

Figure 5:
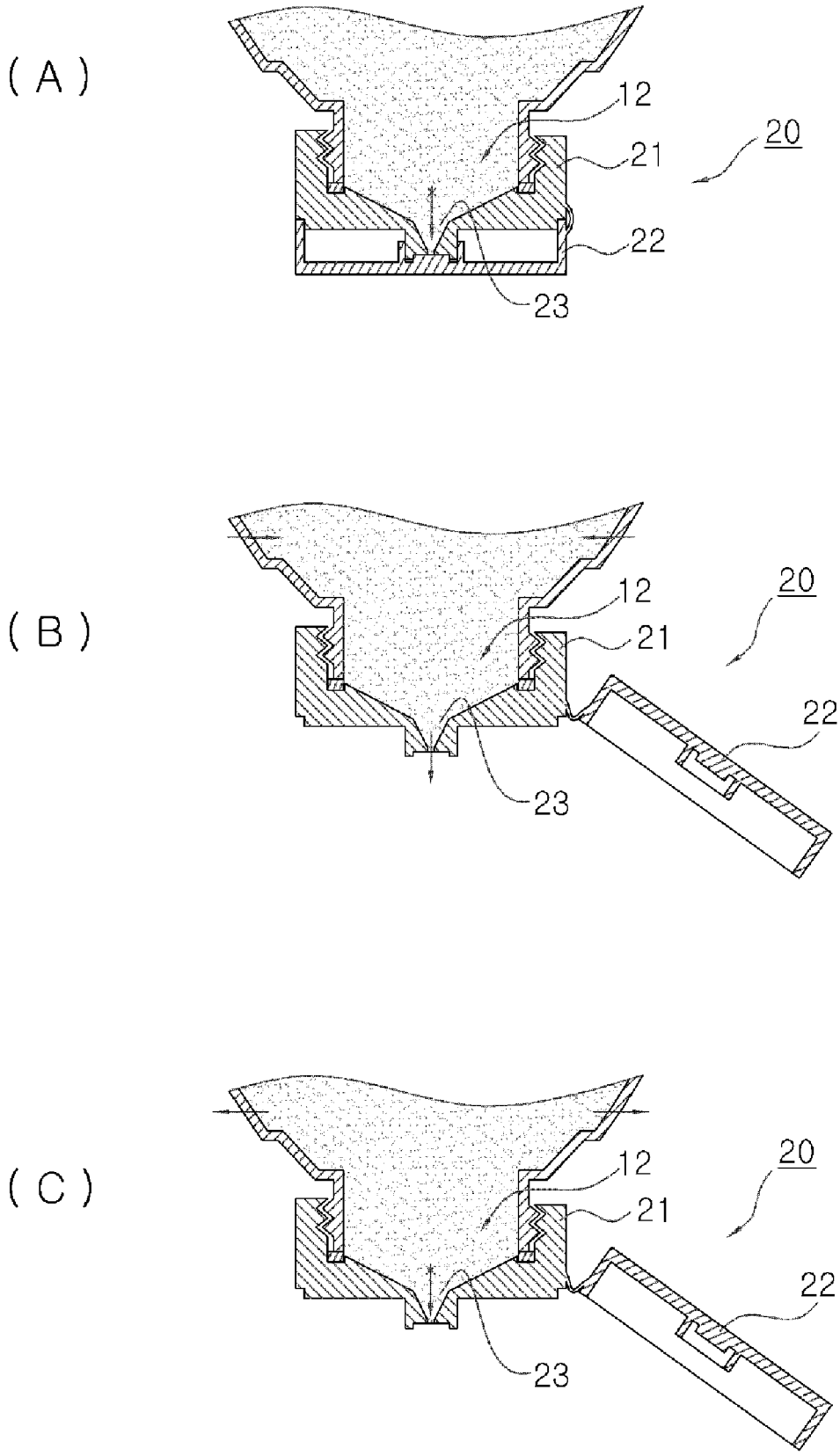

To the contrary, in a structure having the food outlet 12 having a relatively large sectional area as shown in FIG. 5, the structure of the food outlet cap 20 is provided having a cap body 21 coupled to the food outlet 12 so as to permit the food discharge passageway to be narrow and a cover 22 adapted to selectively block the food discharge passageway of the cap body 21.

According to the present invention, the food outlet 12 and the food outlet cap 20 are located along the lower end periphery of the receptacle body 10, and if the lower periphery of the receptacle body 10 is formed large and flat to keep its erecting state by means of the food outlet cap 20, the food can be easily discharged until all consumed.

That is, if the food outlet 12 is located along the lower end periphery of the receptacle body 10, the food is moved downwardly and gathers toward the food outlet 12 while the storage receptacle is kept at a given place, such that it can be easily discharged until all consumed.

The air holes 41 are desirably formed on the sides of the air inlet cap 40, as shown in FIGS. 1 and 3A to 3C, so as to prevent fine dusts from being accumulated therein.

The air hole opening/closing parts 30 can have the various structures as mentioned above.

As shown in FIGS. 3A to 3C and FIGS. 4A and 4B, however, the air hole opening/closing parts 30 have another structure wherein a generally round interrupter 31 that is made of a synthetic resin material in such a manner as to be formed thick in thickness toward the center thereof and relatively thin around the outer periphery thereof is mounted under the air holes 41, while having a fixing protrusion 32 formed at the center thereof so as to be fixed to the air inlet cap 40.

Under the above structure, the interrupter 31 is not easily deformed, thereby having a relatively low failure rate while in use.

In addition to the above-mentioned structure, desirably, the interrupter 31 has a plurality of curved grooves 31*a* formed on the outer periphery thereof such that the outer periphery of the interrupter 31 can be rigidly brought into close contact with the top portion of the air inlet cap 40 by means of the expansion pressure of the food storage space 11.

That is, the formation of the curved grooves 31*a* enables the interrupter 31 not to be easily deformed and allows the interrupter 31 to rigidly come into close contact with the top portion of the air inlet cap 40, such that the air holes 41 are blocked firmly and the interrupter 31 has given elasticity.

Figure 4:
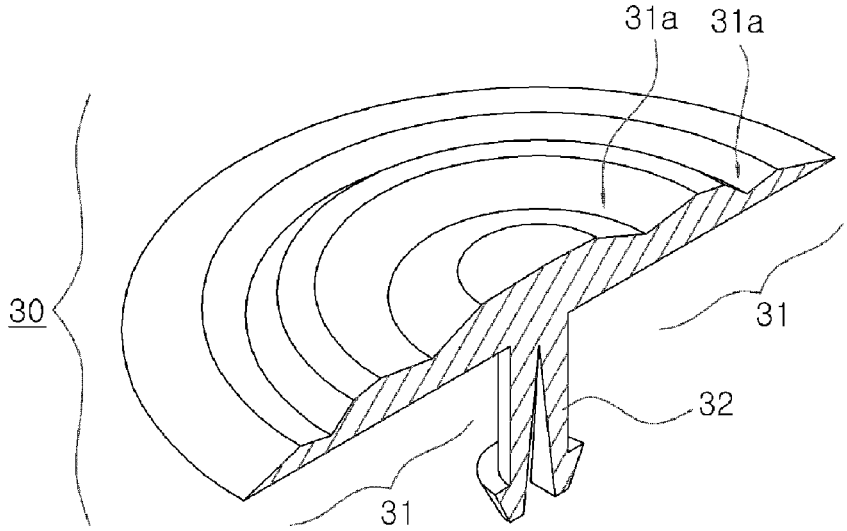
Figure 4:
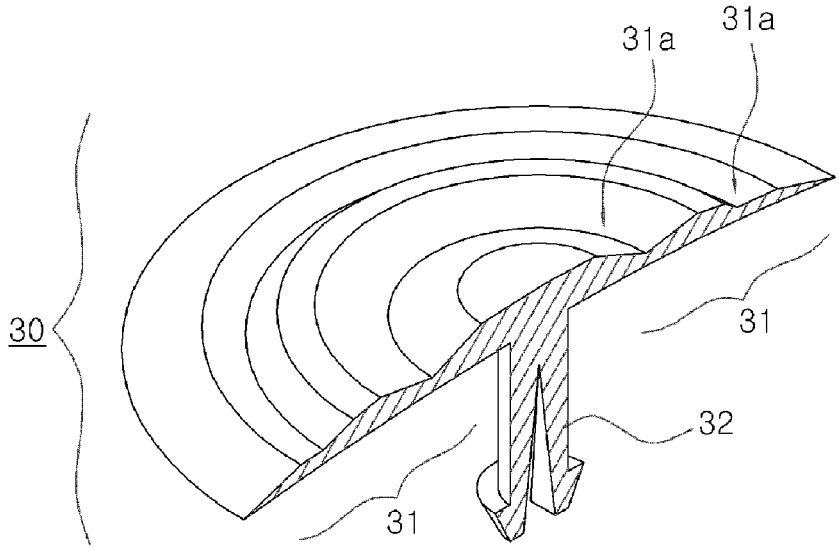

In more detail, as shown in FIG. 4B, the interrupter 31 has the curved grooves 31*a* formed thereon, thereby increasing the area to which the expansion pressure of the food storage space 11 is applied, and if a surface 43 of the air inlet cap 40 opposing to the curved grooves 31*a* is formed concaved, the close contacting force of the interrupter 31 with the surface 43 of the air inlet cap 40 becomes increased according to Pascal's law.

Also, the air flow through the air holes 41 formed on the surface 43 is strong and rapid such that the pressure difference between the air holes 41 becomes high to cause the close contacting force of the interrupter 31 with the surface 43 of the air inlet cap 40 to be greatly increased.

Figure 3:
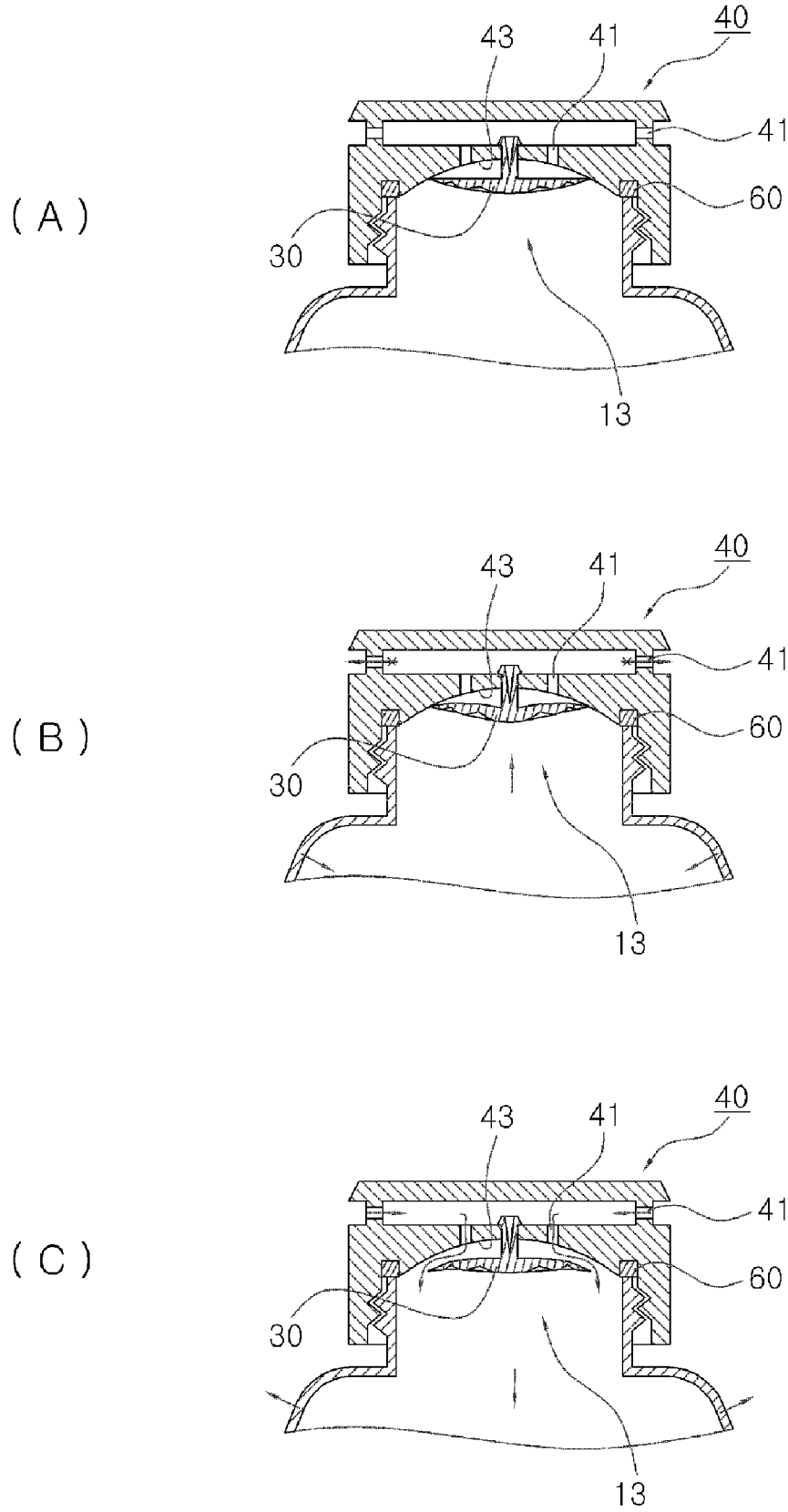

In the above-mentioned structure, as shown in FIGS. 3A to 3C, if the inside surface of the air inlet cap 40 adapted to be tightly contacted with the interrupter 31 is spherically concaved, the interrupter 31 can be more rigidly brought into close contact with the top portion of the air inlet cap 40.

According to the present invention, the air hole opening/closing parts 30 are configured to be brought into contact with the air holes 41 so as to block the air holes 41 when both of the absorbing pressure and the discharging pressure are not generated in the food storage space 11, thereby preventing the air in the food storage space 11 from being in communication with the air at the outside through the air holes 41.

That is, if the air in the food storage space 11 is in communication with the air at the outside, the food stored in the food storage space 11 may be rapidly spoiled and even rotten.

Therefore, there is a need for preventing the air in the food storage space 11 from being in communication with the air at the outside.

Of course, the air holes 41 of the air inlet cap 40 may be selectively opened and closed by means of a separate cap.

Whenever the food is discharged to the outside, however, the separate cap should be opened and closed, which makes it very inconvenient to use.

According to the present invention, the close contact of the air hole opening/closing parts 30 with the air holes 41 by means of the discharging pressure of the food storage space 11 means that the air supply to the air holes 41 is completely blocked, and the blocking of the air holes 41 by the contact of the air hole opening/closing parts 30 with the air holes 41 means that the air does not smoothly communicate with the air holes 41 wherein the air hole opening/closing parts 30 cause a relatively weak blocking state.

An operation of the storage receptacle according to the present invention on the food line of the food manufacturing company will be explained.

At the state where the air inlet 13 is located on the upper portion of the storage receptacle and the food outlet 12 is located on the lower portion thereof, the food pouring from the automatic feeding device of the food line is fed into the storage receptacle.

Also, the food outlet cap 20 is covered on the food outlet 12 such that the food being filled in the food storage space 11 is not leaked to the outsides of the receptacle body 10 and the food outlet cap 20.

Of course, after the food outlet 12 is completely blocked by means of the coated paper 51 or vinyl, preferably, the food outlet cap 20 is coupled to the food outlet 12, which enables the blocking state to be kept more rigid. Under the above configuration, the food outlet 12 is separably coupled to the food outlet cap 20.

Therefore, the food can be safely fed and filled in the food storage space 11.

After the food is filled in the food storage space 11, the food outlet 12 is blocked by means of the coated paper 50, vinyl or a cork cap and is then coupled to the food outlet cap 20, such that the storage receptacle can be circulated in the market.

In order to discharge the food stored in the storage receptacle to the outside, thus, the food outlet cap 20 is first separated from the food outlet 12 and the coated paper 50, the vinyl or the cork cap is then removed.

Next, the food outlet cap 20 is coupled to the food outlet 12 again.

Under the above state, if the outside of the food storage space 11 of the receptacle body 10 is pressed, the food stored therein is discharged by means of the discharging pressure generated in the food storage space 11.

At this time, the air holes 41 are blocked by means of the operations of the air hole opening/closing parts 30, such that the food is not discharged through the air holes 41 and the air is not discharged to the outside, thereby allowing the food to be smoothly discharged to the outside.

If the external force pressing the outside of the food storage space 11 is removed, the food storage space 11 is returned to its original shape, and at this time, the absorbing pressure is generated in the food storage space 11. The air holes 41 being blocked by means of the air hole opening/closing parts 30 are opened by the absorbing pressure, thereby allowing the air to be smoothly supplied to the food storage space 11.

When the food storage space 11 is returned to its original shape, the air by the amount of food discharged is filled in the food storage space 11, such that when the outside of the food space 11 is pressed again, the food can be smoothly discharged to the outside.

According to the present invention, on the other hand, if a large amount of food is discharged through the food outlet 12 having a relatively large diameter, the food can be discharged to a small amount by means of the food outlet cap 20.

That is, as shown in FIGS. 5A to 5C and FIGS. 6 and 7, a food discharge hole 23 having a relatively small diameter is formed such that the amount of food discharged through the food outlet 12 can be reduced to a small amount.

Figure 6:
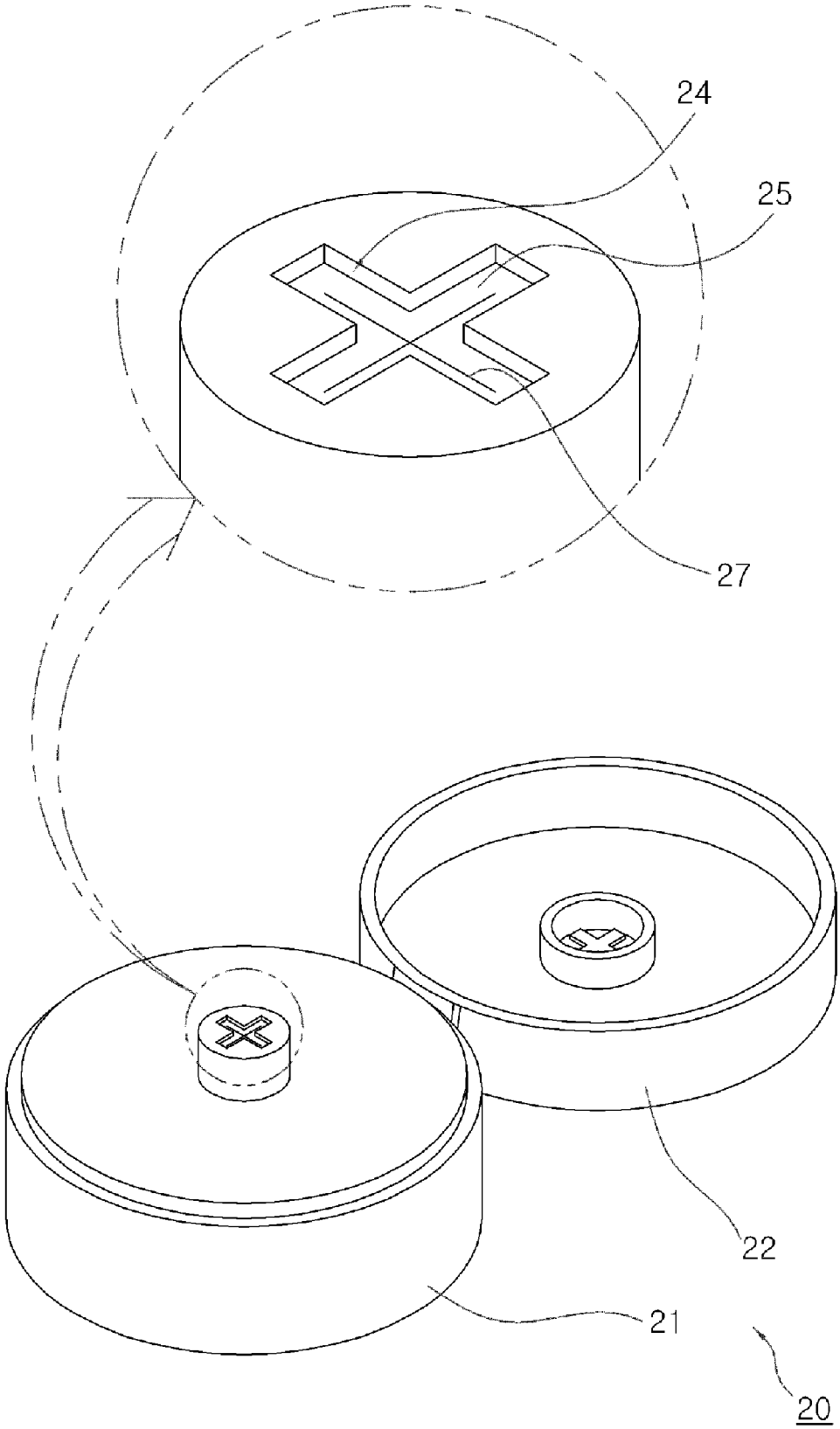
FIG. 6 is a cross-sectional view showing the food outlet cap having a synthetic resin film adapted to be opened only when the external pressure is applied to the receptacle body, wherein the synthetic resin film is at a closed state.
Figure 7:
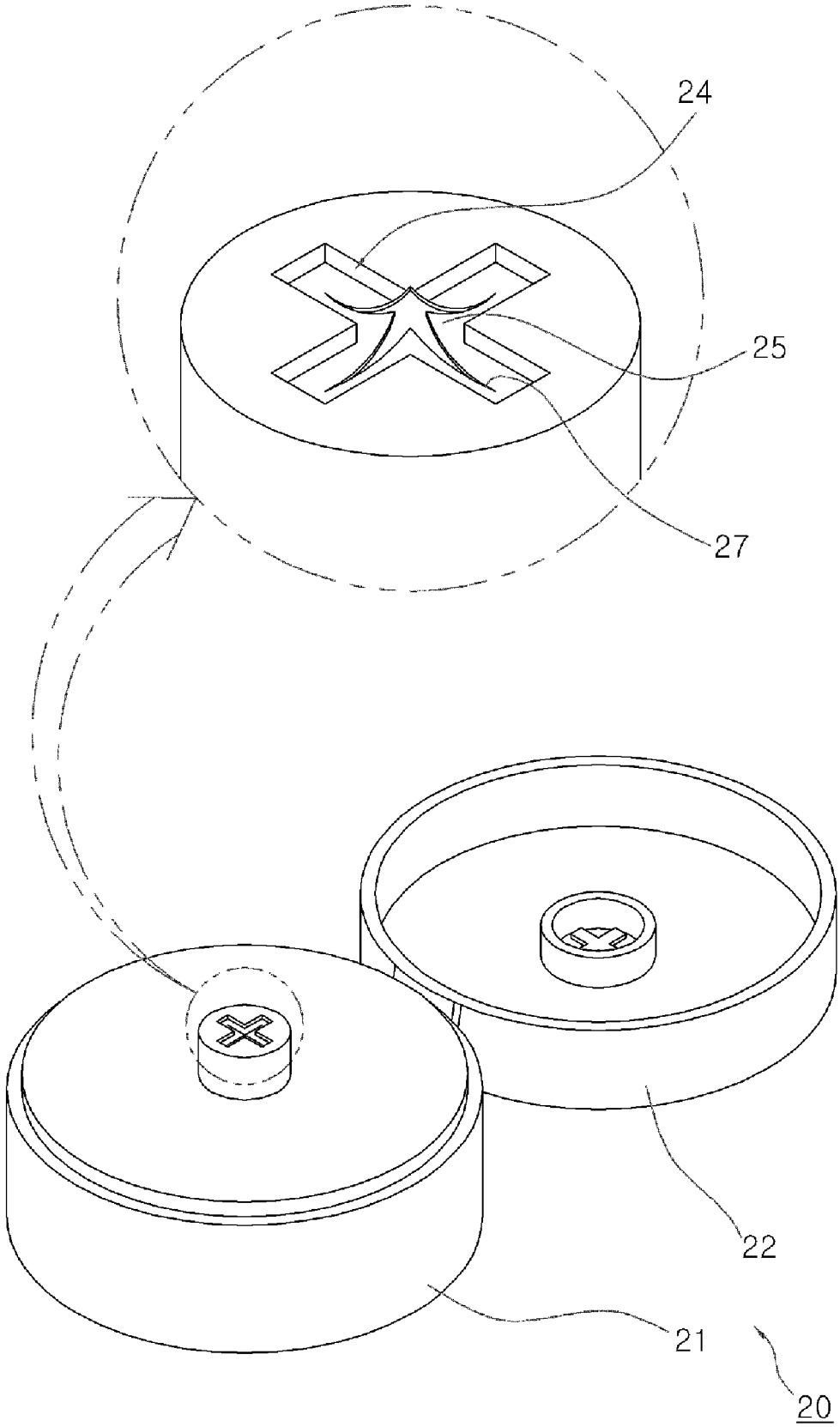
FIG. 7 is a cross-sectional view showing the food outlet cap having the synthetic resin film adapted to be opened only when the external pressure is applied to the receptacle body, wherein the synthetic resin film is at an opened state.
Figure 8:
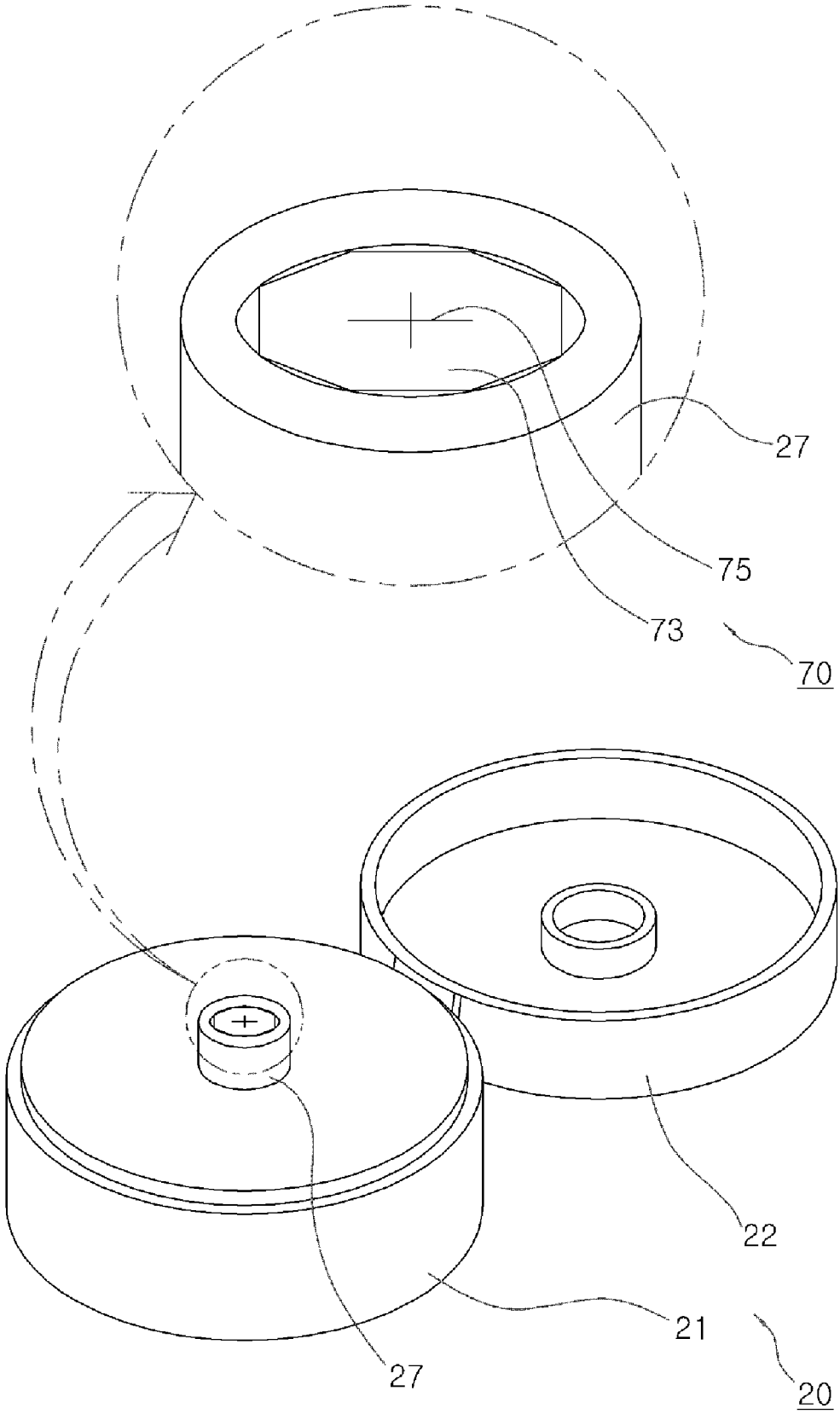
FIG. 8 is a cross-sectional view showing another example of the food outlet cap in the storage receptacle according to the present invention.
Figure 9:
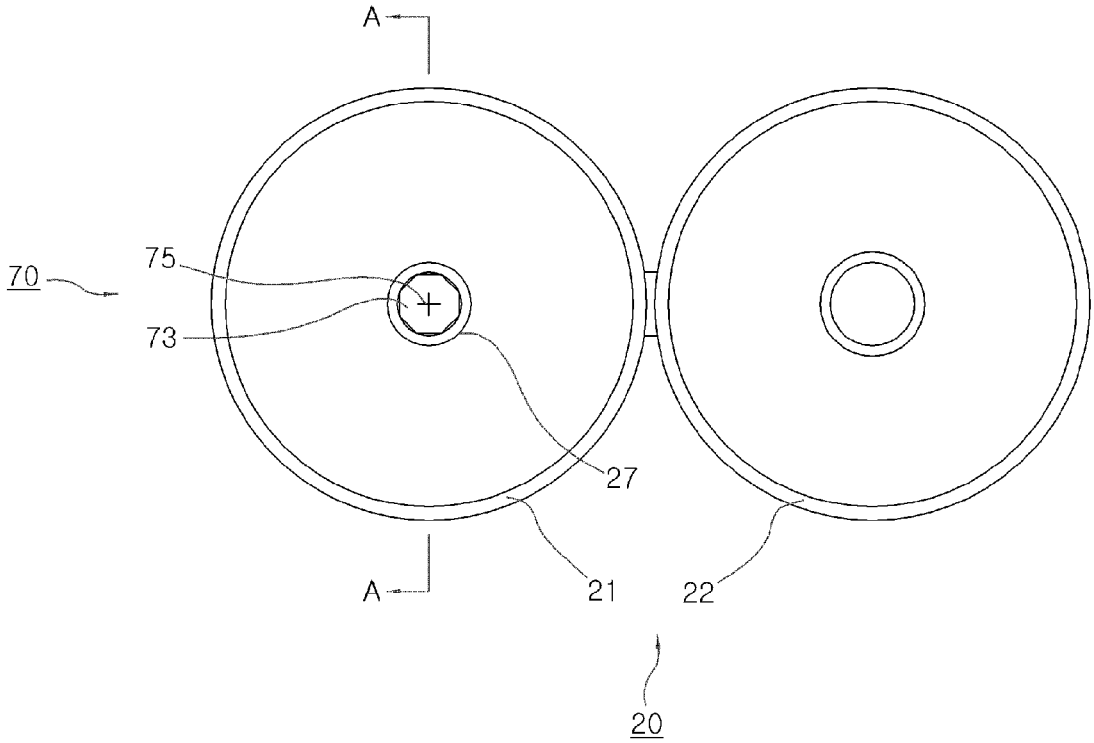
FIG. 9 is a plan view of FIG. 8.
Figure 10:
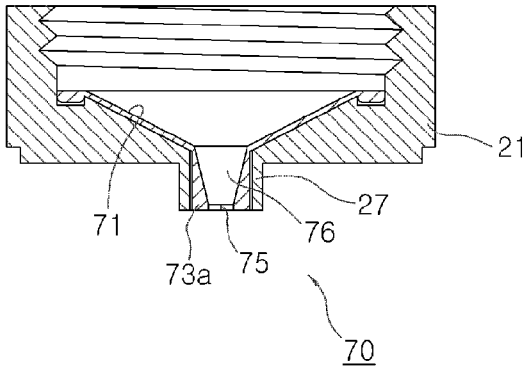
FIG. 10 is a cross-sectional view taken along the line A-A in FIG. 8.
Figure 11:
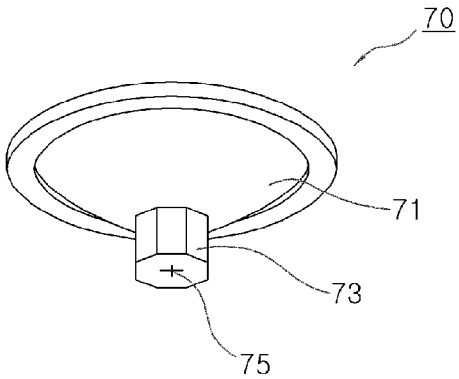
FIG. 11 is a perspective view showing a resin film 70 in FIG. 8.

Under the structures as shown in FIGS. 6 and 7, the food discharge hole 23 can be always kept at a clean state.

The food discharge hole 23 has a plurality of film-mounting grooves 24 formed to cross each other at the end portion thereof, as shown in FIGS. 6 and 7, and the film-mounting grooves 24 have a synthetic resin film 25 formed therein, the synthetic resin film 25 having a plurality of incisions 27 formed along the center portion thereof.

Only when the expansion pressure is applied to the food storage space 11, therefore, the portions where the plurality of incisions 27 are formed are opened as shown in FIG. 7 and the food is discharged therethrough.

On the other hand, as shown in FIGS. 8 to 11, a funnel-like resin film 70 is insertedly mounted on a generally cylindrical protrusion part 27 of the cap body 21, having a semispherical body 71 and a generally octagonal pillar-like discharge protrusion 73 formed on the front end thereof, the discharge protrusion 73 having a plurality of incisions 75 formed thereon, thereby effectively controlling the discharging of the food to the outside.

That is, the discharge protrusion 73 that is adapted to be mounted in the protrusion part 27 has the octagonal pillar-like shape, and the cross-shaped incisions 75 are formed on the front surface of the discharge protrusion 73, such that frames 73*a* formed between the incisions 75 and the discharge protrusion 73 serve as ribs, thereby exerting a relatively strong elastic restoring force.

Thus, if the pressure of the food storage space 11 is removed, the frames 73*a* being opened to open a discharge passageway 76 are rapidly closed to allow the discharge passageway 76 to be rigidly closed, thereby effectively controlling the discharging of the food.

At this time, the width of the discharge passageway 76 becomes smaller toward the front end of the discharge protrusion 73, which enables the elastic restoring force of the frames 73*a* to be increased, thereby more effectively controlling the discharging of the food.

The semispherical body 71 of the resin film 70 is adapted to come into close contact with the inner periphery of the cap body 21, thereby serving as a sealing member preventing the leakage of the food.

Even though not shown, a generally semi-circular resin film having cross-shaped incisions is inserted into the cylindrical protrusion part 27, while having its opened portion oriented to the outside, such that the incisions are formed in the protrusion part 27, which looks like concaved grooves formed in the protrusion part 27 when viewed to the outside.

This enables the discharging of the food to be more effectively controlled.

Figure 12:
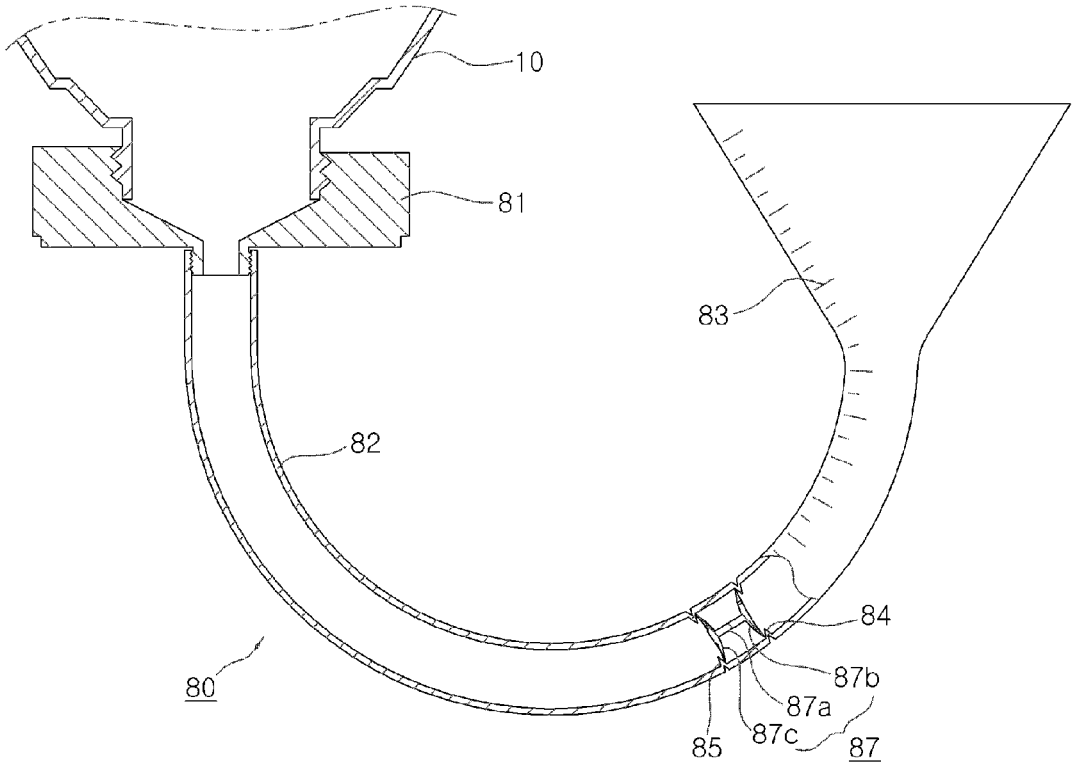
FIG. 12 is a cross-sectional view showing still another example of the food outlet cap in the storage receptacle according to the present invention.
Figure 13:
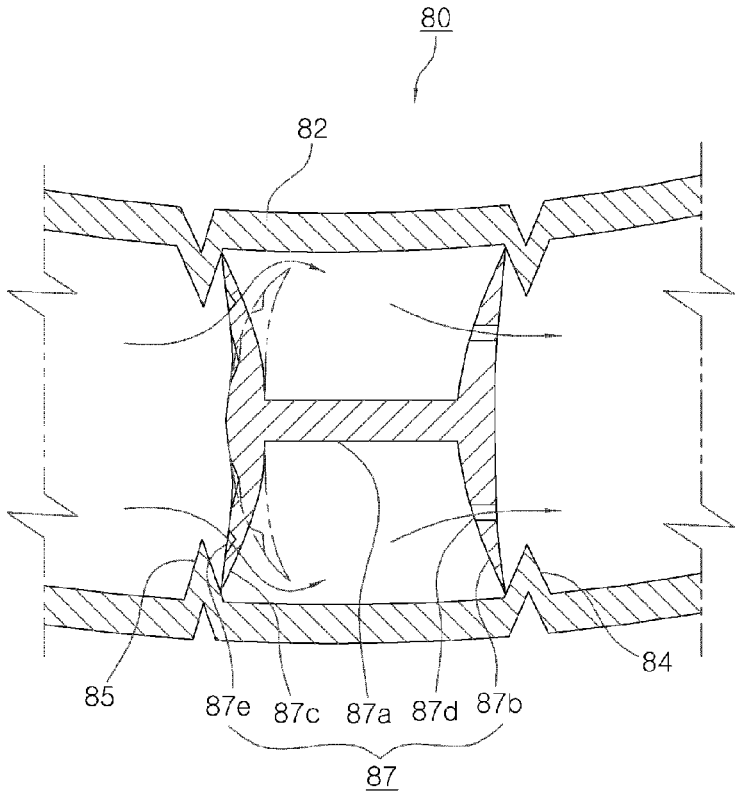
FIG. 13 is a cross-sectional view showing an operating principle of a valve 87 in FIG. 12.

On the other hand, as shown in FIGS. 12 and 13, a food outlet cap 80 may include a cap body 81 having a space opened on only the top surface thereof and a screw portion formed along the inner periphery thereof, a valve body 82 extended outwardly from the cap body 81 in such a manner as to be in communication with the cap body 81, and a valve means (whose reference numeral is not designated herein) mounted in the valve body 82 so as to control an amount of food discharged.

The valve body 82 has graduations 83 formed around the outer periphery thereof, such that the food can be discharged by a user's desired amount.

At this time, as the valve body 82 is extended from the front end thereof to a generally triangular shape, it desirably has an approximately funnel shape.

Further, the valve body 82 is made of a flexible transparent or semi-transparent material, which makes it convenient to use and permits the amount of food discharged to be checked at the outside.

Also, the valve body 82 is detachably mounted at the cap body 81, for example, by means of screw-coupling, which makes it convenient to wash or be kept in place.

Otherwise, the valve body 82 may be integrally formed with the cap body 81.

The valve means includes two round protrusions 84 and 85 formed spaced apart from each other in the inner middle portion of the valve body 82 and a valve 87 disposed between the round protrusions 84 and 85 and made by the application of the air hole opening/closing parts 30.

The valve 87 is composed of a pillar 87*a* and two arc-shaped valve films 87*b* and 87*c* formed to interpose the pillar 87*a* between them.

At this time, the upper valve film 87*b* has a plurality of discharge holes 87*d* formed thereon and the lower valve film 87*c* has a plurality of grooves 87*e* formed thereon so as to expand the surface area thereof.

The valve 87 is closed at one side opened portion thereof by disposing the upper valve film 87*b* on the upper round protrusion 84 and closed at the other side opened portion thereof by disposing the lower valve film 87*c* on the lower round protrusion 85.

Therefore, if the receptacle body 10 is pressed to discharge the food through the valve body 82, the lower valve film 87*c* is raised around the periphery thereof to form a gap between the lower valve film 87*c* and the lower round protrusion 85, and thus, the food is discharged through the gap and the plurality of discharge holes 87 *d*.

At this time, if the pressing pressure against the receptacle body 10 is removed, the raised periphery of the lower valve film 87*c* is returned to its original state by the elastic force thereof to close the gap between the lower valve film 87*c* and the lower round protrusion 85, thereby stopping the discharging of the food.

According to the operation of the valve means as mentioned above, the food can be discharged from the valve body 82 by the user's desired amount.

Further, the valve 87 may have an elastic member like a spring mounted around the pillar 87*a*, so as to adjust the elastic force of the valve 87.

A reference numeral 60 that is not explained herein is a packing member disposed to seal the air inlet as provided on a typical bottle cap.

The storage receptacle according to the present invention can be applied to all kinds of receptacles in which a gel type of material like cosmetics is stored.

INDUSTRIAL APPLICABILITY

According to the storage receptacle of this invention, the food stored therein can be smoothly discharged to the outside.

In general houses, therefore, the foods like ketchup, red pepper paste, mayonnaise and so on are stored in the small-sized storage receptacle of this invention and whenever needed, they are squeezed and discharged, and in food manufacturing companies, such foods are stored for sale in the small-sized storage receptacle of this invention.

Of course, all gel type of materials like cosmetics can be stored for the purpose of distribution and sale.

The invention claimed is:

1. A small-sized food storage receptacle with an air inlet, the storage receptacle comprising:

a receptacle body having a food storage space adapted to be squeezed out of shape by an external pressure applied thereto and be returned to its original shape if the external pressure is removed so as to store a food of a relatively thick liquid state therein, a food outlet adapted to discharge the food to an outside when the food storage space is squeezed out of shape, the air inlet formed along a top portion of the food storage space so as to introduce external air to the food storage space, the air inlet directly receiving the food to be fed into the food storage space from an automatic feeding device in a food manufacturing company, and a sealing member adapted to block the air inlet after the food is filled in the food storage space to prevent the food from leaking to the outside due to an external impact, the sealing member being removable by a user;

an air inlet cap made of a synthetic resin material and adapted to be separably coupled to and enclose an end portion of the receptacle body corresponding to the air inlet, the air inlet cap having a plurality of air holes punched to supply external air to the air inlet of the receptacle body from the inside of the air inlet cap and air hole opening/closing parts adapted to come into close contact with the air holes by means of a discharge pressure generated in the food storage space when the food storage space is squeezed so as to close the air holes and adapted to be separated from the air holes by means of an absorbing pressure generated in the food storage space when the food storage space is returned to its original shape after squeezing so as to allow the external air to be supplied to the food storage space; and a food outlet cap adapted to cover the food outlet of the receptacle body so as to prevent the food outlet from being stained and at the same time to control discharging of the food, the food outlet cap having a cap body coupled to the food outlet so as to permit a food discharge passageway to be narrow and a cover adapted to selectively block the food discharge passageway of the cap body.

2. The storage receptacle according to claim 1, wherein the food outlet and the food outlet cap are located along the lower end periphery of the receptacle body, and the lower periphery of the receptacle body is formed large and flat such that the receptacle body is kept at an erecting state by means of the food outlet cap.

3. The storage receptacle according to claim 1, wherein the air holes are formed on the sides of the air inlet cap so as to prevent dusts from being accumulated therein.

4. The storage receptacle according to claim 1, wherein the air hole opening/closing parts are configured such that a generally round interrupter made of a synthetic resin material in such a manner as to be formed thick toward the center thereof and relatively thin around the outer periphery thereof is mounted under the air holes, the interrupter having a fixing protrusion formed at the center thereof so as to be fixed to the air inlet cap and a plurality of curved grooves formed on the outside thereof to allow the outer periphery of the interrupter to be rigidly brought into close contact with the top portion of the air inlet cap by means of the expansion pressure of the food storage space.

5. The storage receptacle according to claim 4, wherein the inside surface of the air inlet cap adapted to be tightly contacted with the interrupter is spherically concaved.

6. The storage receptacle according to claim 1, wherein the food outlet cap has a food discharge hole formed to have a small diameter so as to discharge a large amount of food discharged through the food outlet to the outside by a small amount, the food discharge hole having a plurality of film-mounting grooves formed to cross each other at the end portion thereof, the film-mounting grooves having a synthetic resin film formed therein, the synthetic resin film having a plurality of incisions formed along the center portion thereof, such that only when the expansion pressure in the food storage space is applied, the portions where the plurality of incisions are formed are opened to allow the food to be discharged therethrough.

7. The storage receptacle according to claim 1, wherein the food outlet cap has the cap body having a space opened on only one surface thereof at the inside thereof, the cap body having a cylindrical protrusion part formed outwardly on the top surface thereof and a funnel-like resin film insertedly fit to the protrusion part of the cap body from the inside thereof, and the resin film has a generally semispherical body serving as a sealing member, a generally octagonal pillar-like discharge protrusion formed protrudedly from the semispherical body and having the discharge passageway formed at the inside thereof in such a manner as to be small in width toward the front end thereof, and a plurality of incisions formed on the front end of the discharge protrusion, such that as the incisions are elastically opened or closed, the discharge passageway is opened or closed to control the discharging of the food to the outside.

8. The storage receptacle according to claim 1, wherein the food outlet cap has the cap body having a space opened on only one surface at the inside thereof, the cap body having a cylindrical protrusion part formed outwardly on the top surface thereof and a resin film of a semicircular shape having a plurality of incisions formed thereon and adapted to be insertedly fit to the protrusion part in such a manner as to allow the opened portion thereof to be oriented to the outside, such that the incisions are located at the inside of the cylindrical protrusion part, thereby serving to control the discharging of the food to the outside.

9. The storage receptacle according to claim 1, wherein the food outlet cap has the cap body having a space opened on only the top surface thereof, a valve body having graduations formed thereon and extended outwardly from the cap body in such a manner as to be in communication with the cap body, and a valve means mounted in the valve body so as to control an amount of the food discharged, and wherein the valve body has two round protrusions formed spaced apart from each other in the inner middle portion of the valve body and a valve disposed between the round protrusions and having a pillar and two arc-shaped valve films formed to interpose the pillar therebetween, one of the valve films having a plurality of discharge holes formed thereon and the other valve film having a plurality of grooves formed thereon such that the other valve film opens and closes the opening of the round protrusion corresponding thereto by means of the pressure from the receptacle body and its own elastic force, thereby controlling the discharging of the food to the outside.

10. The storage receptacle according to claim 1, wherein the air hole opening/closing parts are adapted to come into close contact with the air holes so as to close the air holes when absorbing and discharging pressures are not generated in the food storage space, thereby preventing the air in the food storage space from communicating with external air through the air holes.

11. The storage receptacle according to claim 2, wherein the air hole opening/closing parts are configured such that a generally round interrupter made of a synthetic resin material in such a manner as to be formed thick toward the center thereof and relatively thin around the outer periphery thereof is mounted under the air holes, the interrupter having a fixing protrusion formed at the center thereof so as to be fixed to the air inlet cap and a plurality of curved grooves formed on the outside thereof to allow the outer periphery of the interrupter to be rigidly brought into close contact with the top portion of the air inlet cap by means of the expansion pressure of the food storage space.

12. The storage receptacle according to claim 3, wherein the air hole opening/closing parts are configured such that a generally round interrupter made of a synthetic resin material in such a manner as to be formed thick toward the center thereof and relatively thin around the outer periphery thereof is mounted under the air holes, the interrupter having a fixing protrusion formed at the center thereof so as to be fixed to the air inlet cap and a plurality of curved grooves formed on the outside thereof to allow the outer periphery of the interrupter to be rigidly brought into close contact with the top portion of the air inlet cap by means of the expansion pressure of the food storage space.

13. The storage receptacle according to claim 2, wherein the food outlet cap has a food discharge hole formed to have a small diameter so as to discharge a large amount of food discharged through the food outlet to the outside by a small amount, the food discharge hole having a plurality of film-mounting grooves formed to cross each other at the end portion thereof, the film-mounting grooves having a synthetic resin film formed therein, the synthetic resin film having a plurality of incisions formed along the center portion thereof, such that only when the expansion pressure in the food storage space is applied, the portions where the plurality of incisions are formed are opened to allow the food to be discharged therethrough.

14. The storage receptacle according to claim 3, wherein the food outlet cap has a food discharge hole formed to have a small diameter so as to discharge a large amount of food discharged through the food outlet to the outside by a small amount, the food discharge hole having a plurality of film-mounting grooves formed to cross each other at the end portion thereof; the film-mounting grooves having a synthetic resin film formed therein, the synthetic resin film having a plurality of incisions formed along the center portion thereof, such that only when the expansion pressure in the food storage space is applied, the portions where the plurality of incisions are formed are opened to allow the food to be discharged therethrough.

15. The storage receptacle according to claim 2, wherein the food outlet cap has the cap body having a space' opened on only one surface thereof at the inside thereof, the cap body having a cylindrical protrusion part formed outwardly on the top surface thereof and a funnel-like resin film insertedly fit to the protrusion part of the cap body from the inside thereof, and the resin film has a generally semispherical body serving as a sealing member, a generally octagonal pillar-like discharge protrusion formed protrudedly from the semispherical body and having the discharge passageway formed at the inside thereof in such a manner as to be small in width toward the front end thereof, and a plurality of incisions formed on the front end of the discharge protrusion, such that as the incisions are elastically opened or closed, the discharge passageway is opened or closed to control the discharging of the food to the outside.

16. The storage receptacle according to claim 3, wherein the food outlet cap has the cap body having a space opened on only one surface thereof at the inside thereof, the cap body having a cylindrical protrusion part formed outwardly on the top surface thereof and a funnel-like resin film insertedly fit to the protrusion part of the cap body from the inside thereof, and the resin film has a generally semispherical body serving as a sealing member, a generally octagonal pillar-like discharge protrusion formed protrudedly from the semispherical body and having the discharge passageway formed at the inside thereof in such a manner as to be small in width toward the front end thereof; and a plurality of incisions formed on the front end of the discharge protrusion, such that as the incisions are elastically opened or closed, the discharge passageway is opened or closed to control the discharging of the food to the outside.

17. The storage receptacle according to claim 2, wherein the food outlet cap has the cap body having a space opened on only one surface at the inside thereof, the cap body having a cylindrical protrusion part formed outwardly on the top surface thereof and a resin film of a semicircular shape having a plurality of incisions formed thereon and adapted to be insertedly fit to the protrusion part in such a manner as to allow the opened portion thereof to be oriented to the outside, such that the incisions are located at the inside of the cylindrical protrusion part, thereby serving to control the discharging of the food to the outside.

18. The storage receptacle according to claim 3, wherein the food outlet cap has the cap body having a space opened on only one surface at the inside thereof; the cap body having a cylindrical protrusion part formed outwardly on the top surface thereof and a resin film of a semicircular shape having a plurality of incisions formed thereon and adapted to be insertedly fit to the protrusion part in such a manner as to allow the opened portion thereof to be oriented to the outside, such that the incisions are located at the inside of the cylindrical protrusion part, thereby serving to control the discharging of the food to the outside.

19. The storage receptacle according to claim 2, wherein the food outlet cap has the cap body having a space opened on only the top surface thereof, a valve body having graduations formed thereon and extended outwardly from the cap body in such a manner as to be in communication with the cap body, and a valve means mounted in the valve body so as to control an amount of the food discharged, and wherein the valve body has two round protrusions formed spaced apart from each other in the inner middle portion of the valve body and a valve disposed between the round protrusions and having a pillar and two arc-shaped valve films formed to interpose the pillar therebetween, one of the valve films having a plurality of discharge holes formed thereon and the other valve film having a plurality of grooves formed thereon such that the other valve film opens and closes the opening of the round protrusion corresponding thereto by means of the pressure from the receptacle body and its own elastic force, thereby controlling the discharging of the food to the outside.

20. The storage receptacle according to claim 3, wherein the food outlet cap has the cap body having a space opened on only the top surface thereof, a valve body having graduations formed thereon and extended outwardly from the cap body in such a manner as to be in communication with the cap body, and a valve means mounted in the valve body so as to control an amount of the food discharged, and wherein the valve body has two round protrusions formed spaced apart from each other in the inner middle portion of the valve body and a valve disposed between the round protrusions and having a pillar and two arc-shaped valve films formed to interpose the pillar therebetween, one of the valve films having a plurality of discharge holes formed thereon and the other valve film having a plurality of grooves formed thereon such that the other valve film opens and closes the opening of the round protrusion corresponding thereto by means of the pressure from the receptacle body and its own elastic force, thereby controlling the discharging of the food to the outside.

21. The storage receptacle according to claim 2, wherein the air hole opening/closing parts are adapted to come into close contact with the air holes so as to close the air holes when absorbing and discharging pressures are not generated in the food storage space, thereby preventing the air in the food storage space from communicating with external air through the air holes.

22. The storage receptacle according to claim 3, wherein the air hole opening/closing parts are adapted to come into close contact with the air holes so as to close the air holes when absorbing and discharging pressures are not generated in the food storage space, thereby preventing the air in the food storage space from communicating with external air through the air holes.

* * * * *